US005419070A

United States Patent [19]

Rinehart

[11] Patent Number: 5,419,070

[45] Date of Patent: May 30, 1995

[54] RIFLE UNLOADER APPARATUS

[76] Inventor: Theron N. Rinehart, R.D. 2 Box 817, Thomasville, Pa. 17364

[21] Appl. No.: 185,260

[22] Filed: Jan. 24, 1994

[51] Int. Cl.[6] ..... F41A 35/00

[52] U.S. Cl. ..... 42/90

[58] Field of Search ..... 42/90, 87, 98

[56] References Cited

U.S. PATENT DOCUMENTS

| | | | |
|---|---|---|---|
| 912,643 | 2/1909 | Bengston | 42/90 |
| 2,866,289 | 12/1958 | Wilcox | 42/90 |
| 3,153,296 | 10/1964 | Hofstetter | 42/90 |
| 3,755,947 | 9/1973 | Koon, Jr. . | |
| 4,152,855 | 5/1979 | Du Biel et al. . | |
| 4,194,314 | 3/1980 | Foote . | |
| 4,698,931 | 10/1987 | Larsson . | |
| 4,930,238 | 6/1990 | Poff, Jr. . | |

*Primary Examiner*—Charles T. Jordan
*Assistant Examiner*—Theresa M. Wesson

[57] ABSTRACT

An unloader apparatus in the form of a hand held tool is adapted to safely remove the loaded cartridges in a lever action rifle or similar fireman. In one embodiment, the tool comprises an arcuate shaped spoon attached to a handle. Insertion of the distal end of the spoon into the magazine of the rifle causes the cartridges to back out of the magazine with the arcuate or curved surface of the spoon directing the cartridges harmlessly out of the way.

14 Claims, 3 Drawing Sheets

FIG 6
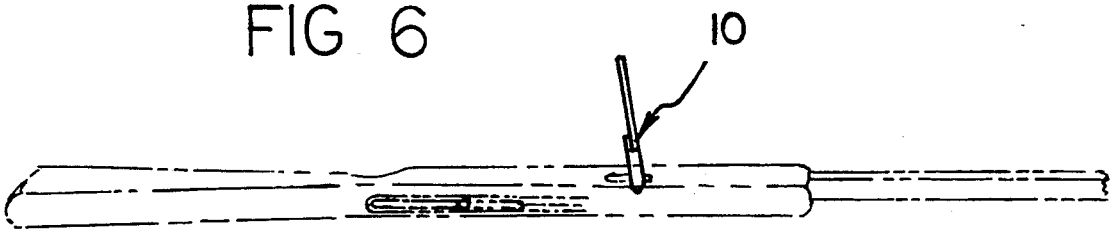
FIG 7
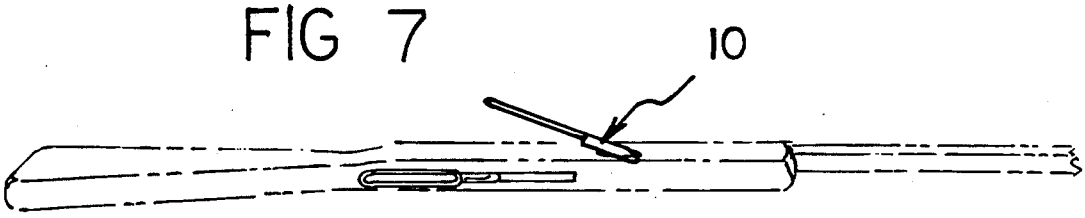
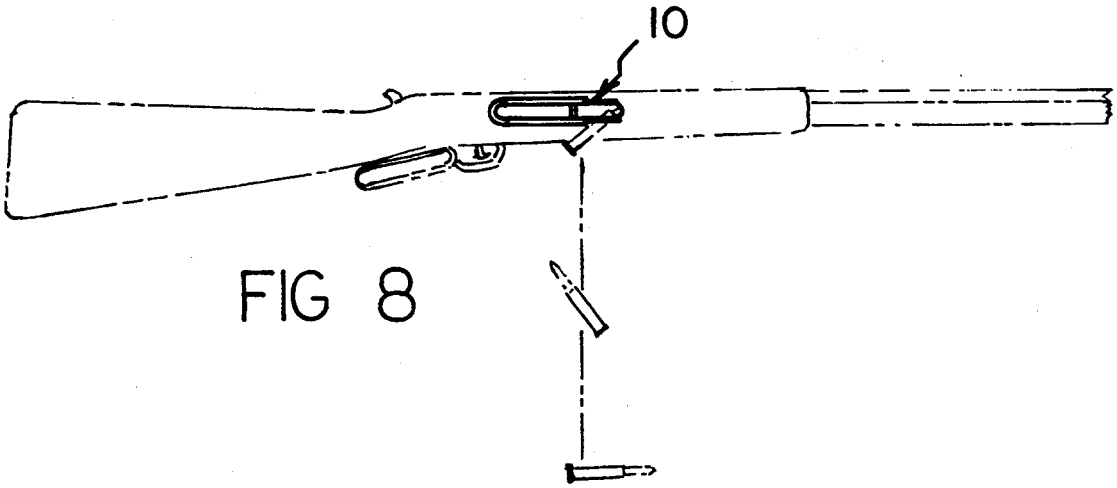
FIG 8

RIFLE UNLOADER APPARATUS

BACKGROUND OF THE INVENTION

1. Field of the Invention

The present invention relates generally to safety devices for firearms, and more particularly, to a hand held tool for facilitating the safe removal of live cartridges or bullets from the magazine of a lever-action rifle or similar firearm.

2. Description of the Prior Art

A lever-action rifle generally comprises a magazine holding several live cartridges or bullets. When it is desired to remove the cartridges, i.e. unload the magazine, each cartridge must be placed in the firing chamber in sequence before being ejected by the action of the lever through the breach of the firearm. This is an inherently unsafe situation because when a live round is in the firing chamber before being ejected the possibility exists for an accidental discharge. Accordingly, there is a clear need for a method and means for unloading the live cartridges in the magazine of a lever-action rifle or the like without first sequentially indexing each round through the firing chamber of the firearm. The foregoing need is met by the unique rifle unloader apparatus of the present invention and method of using same as will be made apparent from the following description thereof. Other advantages of the present invention over the prior art also will be rendered evident.

SUMMARY OF THE INVENTION

To achieve the foregoing and other advantages, the present invention, briefly described, provides an unloader apparatus in the form of a hand held tool is adapted to safely remove the loaded cartridges in a lever action rifle or similar fireman. In the preferred embodiment, the tool comprises an arcuate shaped spoon attached to a handle. Insertion of the distal end of the spoon into the magazine of the rifle causes the cartridges to back out of the magazine with the arcuate or curved surface of the spoon directing the cartridges harmlessly out of the way.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment(s) of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved rifle unloader apparatus which has all of the advantages of the prior art and none of the disadvantages. It is another object of the present invention to provide a new and improved rifle unloader apparatus which may be easily and efficiently manufactured and marketed.

It is a further objective of the present invention to provide a new and improved rifle unloader apparatus which is of durable and reliable construction.

An even further object of the present invention is to provide a new and improved rifle unloader apparatus which is susceptible to a low cost of manufacture with regard to both materials and labor, and which accordingly is then susceptible to low prices of sale to the consuming public, thereby making such rifle unloader apparatus available to the buying public.

Still yet a further object of the present invention is to provide a new and improved rifle unloader apparatus in the form of a hand held tool.

It is still a further object of the present invention to provide a new and improved rifle unloader apparatus having means associated therewith for collecting the live cartridges unloaded thereby from the magazine of a lever-action rifle or similar firearm.

Still a further object of the present invention is to provide a new and improved rifle unloader apparatus and method of using the same whereby the sequential indexing of each live round in the rifle's magazine through the firing chamber of the firearm prior to being ejected is avoided.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated at least one preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 6 is a perspective view illustrating the placement of the rifle unloader apparatus relative to the rifle at the beginning of the unloading sequence.

FIG. 7 is a perspective view illustrating the placement of the rifle unloader apparatus relative to the rifle at a later intermediate stage of the unloading sequence.

FIG. 8 is a perspective view illustrating the placement of the rifle unloader apparatus relative to the rifle when the cartridges are being ejected.

DESCRIPTION OF THE PREFERRED EMBODIMENT

With reference now to the drawings, a new and improved rifle unloader apparatus of the present invention will be described.

Figure 3:
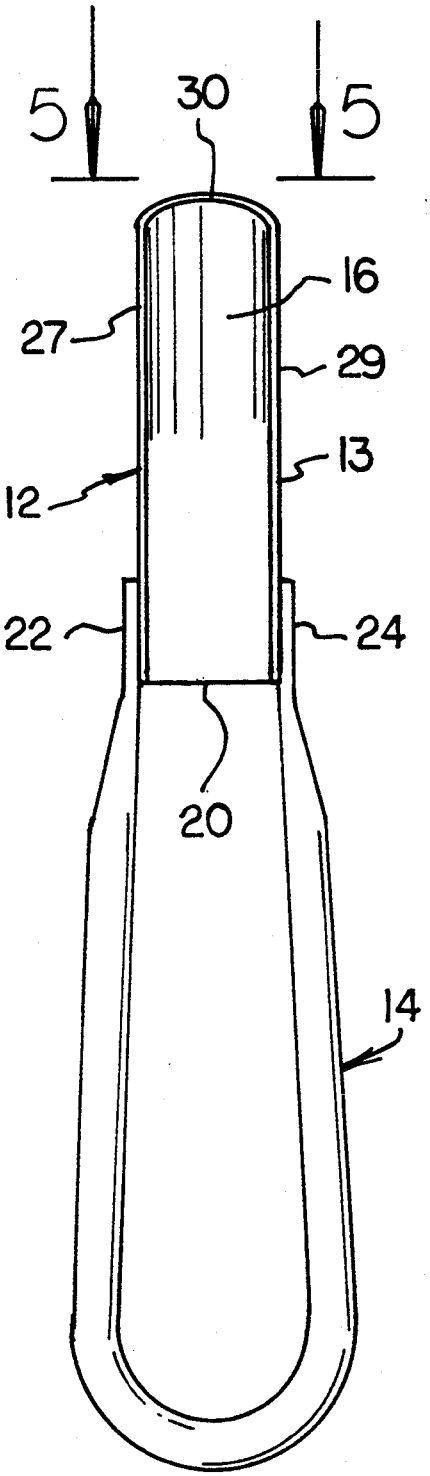
FIG. 3 is a top plan view of the rifle unloader apparatus of FIG. 2.
Figure 4:
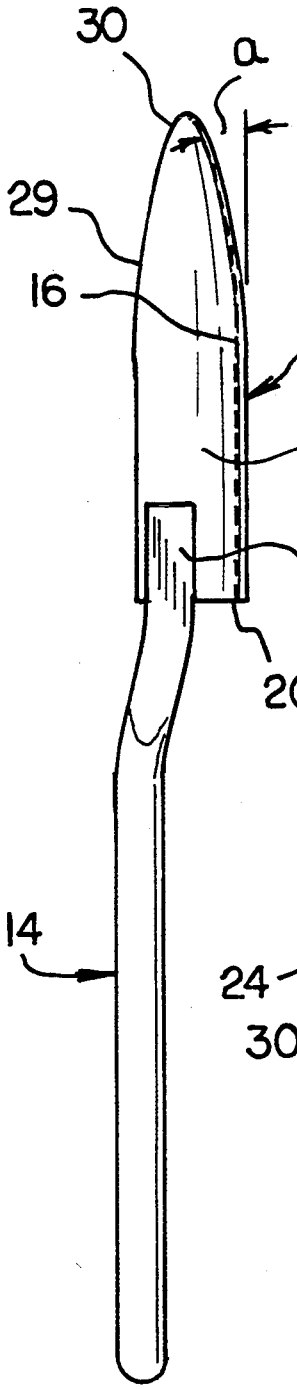
FIG. 4 is a side elevational view of the rifle unloader apparatus of FIG. 2.

Turning initially to FIGS. 1–5, there is shown a first exemplary embodiment of the rifle unloader apparatus according to the invention generally designated by reference numeral 10. In its preferred form, rifle unloader apparatus 10 comprises a hand holdable tool generally resembling a spoon and having a front portion 12 integrally connected to a rear handle portion 14. The front portion, in turn, comprises a bowl or scoop 16 integrally attached to a generally cylindrical body member 13 having a rear facing flat end 20 defining a rear arcuately shaped opening. Handle 14 preferably is in the form of a U-shaped tube whose opposed ends 22, 24 are flattened so that they may suitably be attached to the body member perpendicular to an orthogonal plane in which arcuate end surface 20 is projected. As shown in FIG. 4, the U-shaped tube preferably includes offset portions which permit the opposed ends of the U-shaped tube to lie within a first plane, with a remainder of said U-shaped tube residing in a second plane positioned in a substantially spaced and parallel orientation relative to the first plane. The parts may be fabricated of wood, plastic or metal with brass being particularly preferred, in which case the flattened ends 22, 24 preferably are attached to the opposed sides of the body member 12 by soldering, for example. Of course, it will be appreciated that other means to fasten handle 14 to the body member may be employed instead depending upon the choice of material for these parts e.g., a plastic version may be provided of molded one-piece construction. Also, handle 14 may assume other convenient shapes, if desired.

Figure 1:
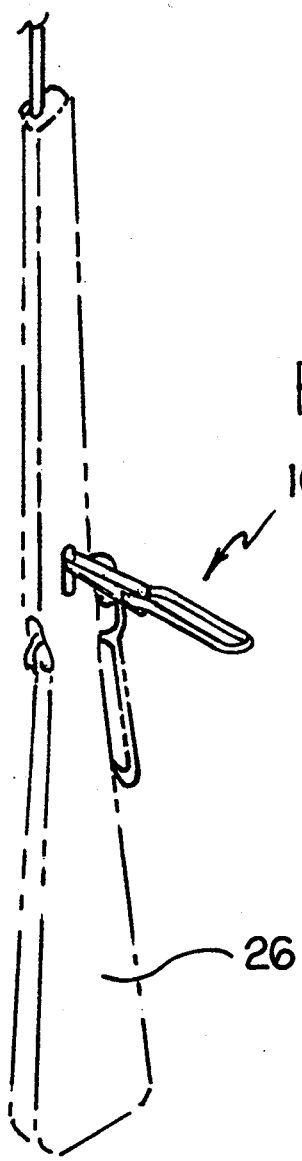
FIG. 1 is a perspective view showing the first preferred embodiment of the rifle unloader apparatus of the invention in use with a lever-action rifle.
Figure 2:
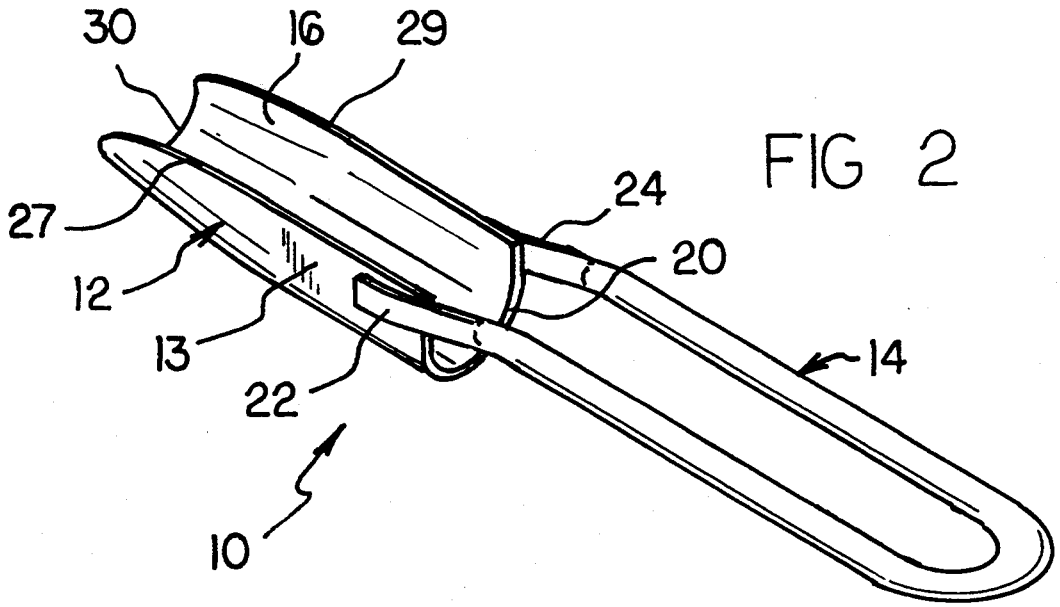
FIG. 2 is a perspective view showing the first preferred embodiment of the rifle unloader apparatus of the invention.

In accordance with the present invention the leading edge of scoop 16 is adapted to be positioned by hand (i.e. by gripping handle portion 14) relative to the conventional magazine of a conventional lever-action rifle 26 or similar fireman as is only schematically shown in FIG. 1 by dashed lines. This type of firearm is well known and commercially available under the Registered Trademarks WINCHESTER or MARLIN, and the structural details of same are outside the scope of the present invention. Suffice it to say for a proper understanding of the invention, the scoop 16 is so shaped that by proper manipulation of tool 10, as will be described more fully below, the scoop is adapted to bear flush against the spring-loaded door of the magazine of such a firearm and in such manner as to cause the door of the magazine to depress to its open condition. Continued axial pressure of tool 10 against the magazine door with the scoop 16 facing the front or barrel of rifle 26 will tend to cause the magazine door to remain in its depressed condition which action, in turn, automatically causes any live bullet shells or cartridges in the magazine to back out of or be ejected from the magazine. The ejected shells are then deflected by the scoop 16 which by reason of its shape guides the cartridges harmlessly to the rear through the opening defined by arcuate edge 20, or otherwise out of harm's way. The single live round in the firing chamber, if any, may then be ejected in the usual manner by cocking the lever of the rifle to thereby cause ejectment of the live round through the breach of the firearm. By following this procedure utilizing the unloader tool 10 of the present invention, a potentially dangerous lever action-action rifle or the like having live cartridges in its magazine may easily and rapidly be safed (unloaded). Without employing the tool 10, the only way to unload the magazine of the firearm would be to cock the lever for as many times as there are live shells in the magazine forcing each shell to be placed in the firing chamber and then ejected through the breach of the rifle. Such a procedure (avoided by the present invention) is highly dangerous being susceptible to an accidental misfire each time a cartridge is in the firing chamber.

Figure 5:
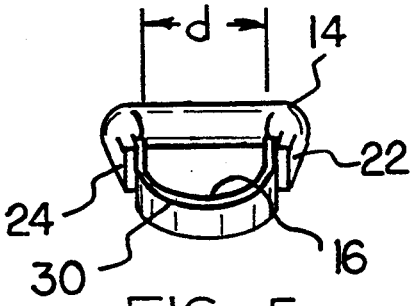
FIG. 5 is a end elevational view of the rifle unloader apparatus of FIG. 2 taken along 5—5 of FIG. 3.

More specifically, and as best seen in FIGS. 3–5, the distal or nose portion of scoop 16 is tapered upwardly from the bottom of the body portion 12 by an acute angle indicated by "a" in FIG. 4 with angle "a" preferably being in the range from about 15 degrees to about 45 degrees. In addition, the nose portion of the scoop has a pair of opposed top edges 27, 29 that gradually taper downwardly from arcuate rear edge 20 with the two top edges intersecting the bottom surface tapering upwardly to form the scoop's leading edge 30 substantially as shown. The concave floor of scoop 16 extends rearwardly along the longitudinal extent of scoop 16 terminating in arcuate rear edge 20 and serves as a guide surface for harmlessly deflecting any cartridge shells being ejected from the magazine of a lever action rifle or similar firearm toward the rear opening. The transverse dimension of the scoop is indicated by the letter "d" in FIG. 5 and essentially is the same as the transverse dimension of the magazine of a conventional lever-action rifle such as that commercially available under the Registered Trademark WINCHESTER MODEL 94, for example. The tapered nose configuration of scoop 16 substantially as shown in the drawings facilitates abutting engagement against the door of the magazine and retention thereagainst as well as correct orientation of the concave surface of scoop 16 to harmlessly deflect any cartridges in the magazine being ejected, and therefore is an important feature of the invention. The floor and curved sides of scoop 16 preferably are made thick enough to resist deformation when bearing against the tempered steel magazine door of a conventional lever-action firearm and axially overcoming the spring bias of the magazine door as will be well understood by the routineer.

FIGS. 6 through 7 illustrate the sequence of events when the tool 10 is used to unload cartridges from the rifle's magazine. In FIG. 6, the scoop nose portion is caused to bear against the door of the rifle's magazine. In FIG. 7, the tool is titled back toward the stock of the rifle so that it is at an acute angle with respect to the rifle stock substantially as shown. This enables the cartridges to back out of the rifle's magazine and enter the scoop 16 of the tool. FIG. 8 schematically shows the shells or cartridges in the magazine of rifle being ejected with the aid of tool 10.

It is believed readily apparent from the foregoing that the present invention accomplishes all of the objectives set forth by providing a new and improved rifle unloader apparatus in the form of a hand held tool, having means associated therewith for collecting the live cartridges unloaded thereby from the magazine of a lever-action rifle or similar firearm, and which may be used to safely unload the magazine of a lever-action firearm or the like without first sequentially indexing each live round in the rifle's magazine through the firing chamber of the firearm prior to being ejected.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A rifle unloader apparatus comprising:

a front portion including a scoop integrally attached to a generally cylindrical body member, the cylindrical body member having a rear facing flat end defining a rear arcuately shaped opening, said front portion having a front portion longitudinal axis; and a rear handle portion coupled to said front portion, said rear handle portion comprising a U-shaped tube having opposed ends with a first one of said opposed ends being coupled to a first exterior side of said cylindrical body member, and a second one of said opposed ends being coupled to a second exterior side of said cylindrical body member, said rear handle portion being having a rear handle portion longitudinal axis, wherein said front portion longitudinal axis is oriented substantially parallel to said rear handle portion longitudinal axis.

2. The apparatus of claim 1, wherein said U-shaped tube includes offset portions such that said opposed ends of said U-shaped tube lie within a first plane, with a remainder of said U-shaped tube residing in a second plane, wherein said first plane is oriented in a substantially spaced and parallel orientation relative to said second plane.

3. The apparatus of claim 2, wherein said opposed ends of said U-shaped tube are flattened at a junction of the opposed ends and the respective exterior sides of said cylindrical body member.

4. The apparatus of claim 3, wherein said front portion includes a distal edge portion means for abuttingly engaging a door of a magazine of a lever-action firearm.

5. The apparatus of claim 4, wherein said front portion further includes a guide surface means positioned proximal to said distal edge portion means for guiding bullet shells from a magazine of a rifle.

6. The apparatus of claim 5, wherein said guide surface means comprises a concave shape formed into said scoop.

7. The apparatus of claim 1, wherein said rear facing flat end extends below said rear handle portion to define a rear flat end means for engaging a rear edge of an opening of a magazine of a firearm to preclude movement of said apparatus relative to said firearm.

8. A rifle unloader apparatus comprising:

a front portion including a scoop integrally attached to a generally cylindrical body member, the cylindrical body member having a rear facing flat end defining a rear arcuately shaped opening, said front portion having a front portion longitudinal axis; and a rear handle portion coupled to said front portion, said rear handle portion comprising a U-shaped tube having opposed ends with a first one of said opposed ends being coupled to a first exterior side of said cylindrical body member, and a second one of said opposed ends being coupled to a second exterior side of said cylindrical body member, said rear handle portion being having a rear handle portion longitudinal axis.

9. (Newly added) The apparatus of claim 8, wherein said U-shaped tube includes offset portions such that said opposed ends of said U-shaped tube lie within a first plane, with a remainder of said U-shaped tube residing in a second plane, wherein said first plane is oriented in a substantially spaced and parallel orientation relative to said second plane.

10. The apparatus of claim 9, wherein said opposed ends of said U-shaped tube are flattened at a junction of the opposed ends and the respective exterior sides of said cylindrical body member.

11. The apparatus of claim 10, wherein said front portion includes a distal edge portion means for abuttingly engaging a door of a magazine of a lever-action firearm.

12. The apparatus of claim 11, wherein said front portion further includes a guide surface means positioned proximal to said distal edge portion means for guiding bullet shells from a magazine of a rifle.

13. The apparatus of claim 12, wherein said guide surface means comprises a concave shape formed into said scoop.

14. The apparatus of claim 13, wherein said rear facing flat end extends below said rear handle portion to define a rear flat end means for engaging a rear edge of an opening of a magazine of a firearm to preclude movement of said apparatus relative to said firearm.

* * * * *